United States Patent [19]

Heeb et al.

[11] 4,322,037

[45] Mar. 30, 1982

[54] AEROSOL CAN, HAVING A SUPER-FINE ATOMIZATION VALVE, WITH A FILLING WHICH CONTAINS A PROPELLANT, PROCESS FOR ITS MANUFACTURE, AND ITS USE

[75] Inventors: Dieter Heeb; Günter Bechmann; Uwe Bergemann; Volker Böllert; Claus-Dieter Frenzel, all of Hamburg, Fed. Rep. of Germany

[73] Assignee: Hans Schwarzkopf GmbH, Hamburg, Fed. Rep. of Germany

[21] Appl. No.: 93,950

[22] Filed: Nov. 14, 1979

[30] Foreign Application Priority Data

Nov. 15, 1978 [DE] Fed. Rep. of Germany ..... 2849599

[51] Int. Cl.[3] ..... B05B 1/34; B65D 83/14

[52] U.S. Cl. ..... 239/337; 222/402.24; 222/492; 222/573; 239/492; 239/573

[58] Field of Search ..... 222/402.24, 547, 564, 222/402.18; 239/337, 573, 579, 490, 491, 492

[56] References Cited

U.S. PATENT DOCUMENTS 3,226,040 12/1965 Briechle et al. ..... 239/573 X
3,314,571 4/1967 Greenebaum ..... 222/564 X
4,071,196 1/1978 Burke et al. ..... 239/492
4,117,958 10/1978 Spitzer et al. ..... 222/402.18

FOREIGN PATENT DOCUMENTS 1400731 7/1969 Fed. Rep. of Germany ..... 239/337
1575851 11/1976 Fed. Rep. of Germany .
2705872 9/1977 Fed. Rep. of Germany .
1217524 12/1970 United Kingdom ..... 222/402.24

OTHER PUBLICATIONS

"Aerosol Spray Can", *The Illustrated Science and Invention Encyclopedia,* A. S. Stuttman Co., Inc., N.Y., N.Y., 1977, p. 28.

*Primary Examiner*—Andres Kashnikow
*Attorney, Agent, or Firm*—Beveridge, DeGrandi, Kline, Lunsford

[57] ABSTRACT

An aerosol can having a super-fine atomization valve, a process for its manufacture, and a process for introducing a filling which contains a propellant into the can. The can imparts a suitable fine division of droplets to the propellant medium which is to be sprayed. The can is suitable for the spraying of homogeneous mediums which do not contain chlorofluorinated hydrocarbons or hydrocarbon propellant gases.

8 Claims, 15 Drawing Figures

AEROSOL CAN, HAVING A SUPER-FINE ATOMIZATION VALVE, WITH A FILLING WHICH CONTAINS A PROPELLANT, PROCESS FOR ITS MANUFACTURE, AND ITS USE

The present invention relates to an aerosol can with a filling which contains a propellant, to a process for introducing the filling and to its use.

It is an object of the present invention to provide an aerosol can which imparts a suitable fine division of droplets to the propellant-containing medium which is to be sprayed, in particular for those propellant-containing media which are felt by the users to be excessively wet when hitherto known devices of similar construction are used.

In this connection, it is a further object of the present invention to spray propellant-containing media of a type which 1. is present in the pressurised-gas container as a stable homogeneous solution—that is to say as a single liquid phase—so that, in use, the spray is always dispensed in the same composition, 2. has the greatest possible proportion of non-inflammable constituents in the solution so that, as far as possible, transport, storage and use can be free from accident risk and the environment cannot be polluted, 3. is free from chlorofluorinated hydrocarbons and hydrocarbon propellant gases and thus represents a safety aerosol preparation, 4. has drying times and spraying properties, at least when a specially adapted pressure valve is used, which largely correspond to the known aerosol preparations based on fluorochlorohydrocarbon propellant gases, and, 5. according to the conventional methods for measuring a flame jet, does not give a flame jet and does not contain more than 45 percent by weight of inflammable constituents.

The subject of the invention is an aerosol can with a homogeneous solution as a propellant filling, formulated as a medicinal spray, cosmetic spray or room spray, which aerosol can is provided with a self-closing spray valve, as a super-fine atomisation valve, for pressure containers which contain solutions of a gas and/or liquid, having a valve stem which, inside a valve housing, is axially movable in the direction of opening against the action of a closing compression spring which is backed up by the valve housing, an axial outlet channel in the valve stem being connected to the interior of the pressure container by means of a radical outlet channel which ends in an annular groove in the valve stem, the radical outlet channel thereof being sealed, in the closed position, by an elastic annular grommet, the cylindrical internal circumference of which engages in the annular groove with a radial bias and the external edge of which is not clamped between the valve housing and the dome of the cap, the shoulder, which faces the container, of the annular groove, when in the closed position, being in tight contact with the grommet under the action of the closing compression spring, whilst the forces which are exerted by the annular groove in the valve stem on the circumferential sections, which are above the neutral bending zone, of the hole in the grommet are composed of a force component which is in each case radial to the valve stem and of a force component which is parallel to the axis, which components are greatest at the upper edge, and, when the valve is closed, the forces which are exerted by the annular groove in the valve stem on the circumferential sections, which are below the neutral bending zone, of the hole in the grommet are also in each case composed of a force component which is radial to the valve stem and of a force component which is parallel to the axis, these force components being greatest at the lower edge of the hole of the grommet, and which aerosol can is in a form adapted to the specific intended use by combining the embodiments a, b, c, d, e and f in such a way that (a) a restrictor in the shape of a body with a cylindrical bore is located in compression in the axial outlet channel of the valve stem part and, in the centrally arranged restricting channel, a bridge member is provided which is located in the centre of the restrictor and contains the passage orifice, (b) the turbulent-spray head with the inserted turbulence jet is firmly but releasably attached and the spray head has a cylindrical jet-receiving plug having two surfaces which are parallel to the axis and, as viewed from the jet orifice, are vertically arranged, (c) the jet-receiving plug carries the forced-on turbulence jet, four raised webs of which rest on the end face of the jet-receiving plug (d) the four webs around the jet orifice on the inside of the turbulence jet form an approximately cylindrical turbulence chamber and the webs free the inlet channels which are in a location tangential to the circular jet orifice, (e) a cylindrical recess is located on the outer surface of the turbulence jet, concentrically to the jet orifice, and (f) the turbulent-spray head contains an approximately eccentrically arranged, tapering chamber which communicates with the annular channel and merges into the receiving opening which is located underneath and is to receive the valve stem part.

In the drawings, namely FIGS. 1 to 13, the aerosol can is explained by reference to the illustrative embodiments represented, in which.

Figure 1:
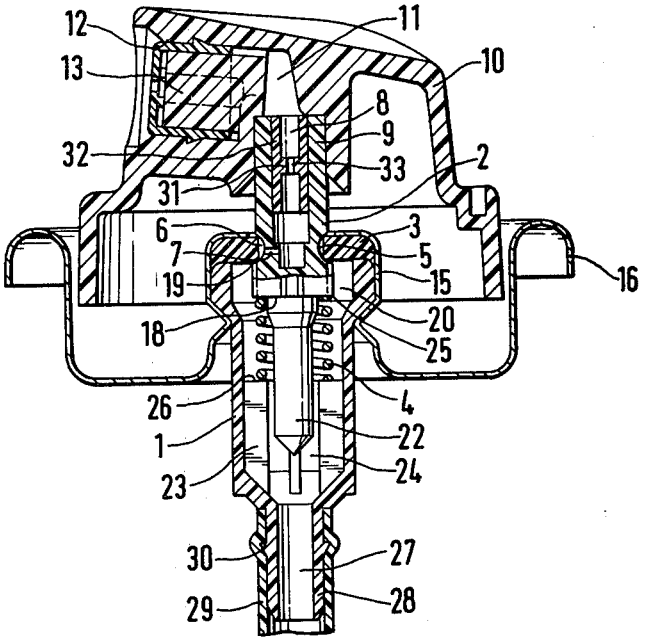
FIG. 1 shows a spray valve in the closed state, in a vertical longitudinal section.
Figure 2:
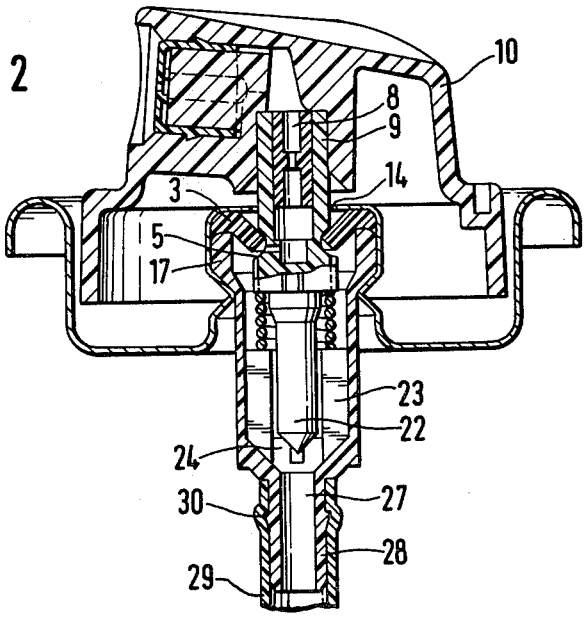
FIG. 2 shows the spray valve according to FIG. 1 in the opened state.
Figure 3:
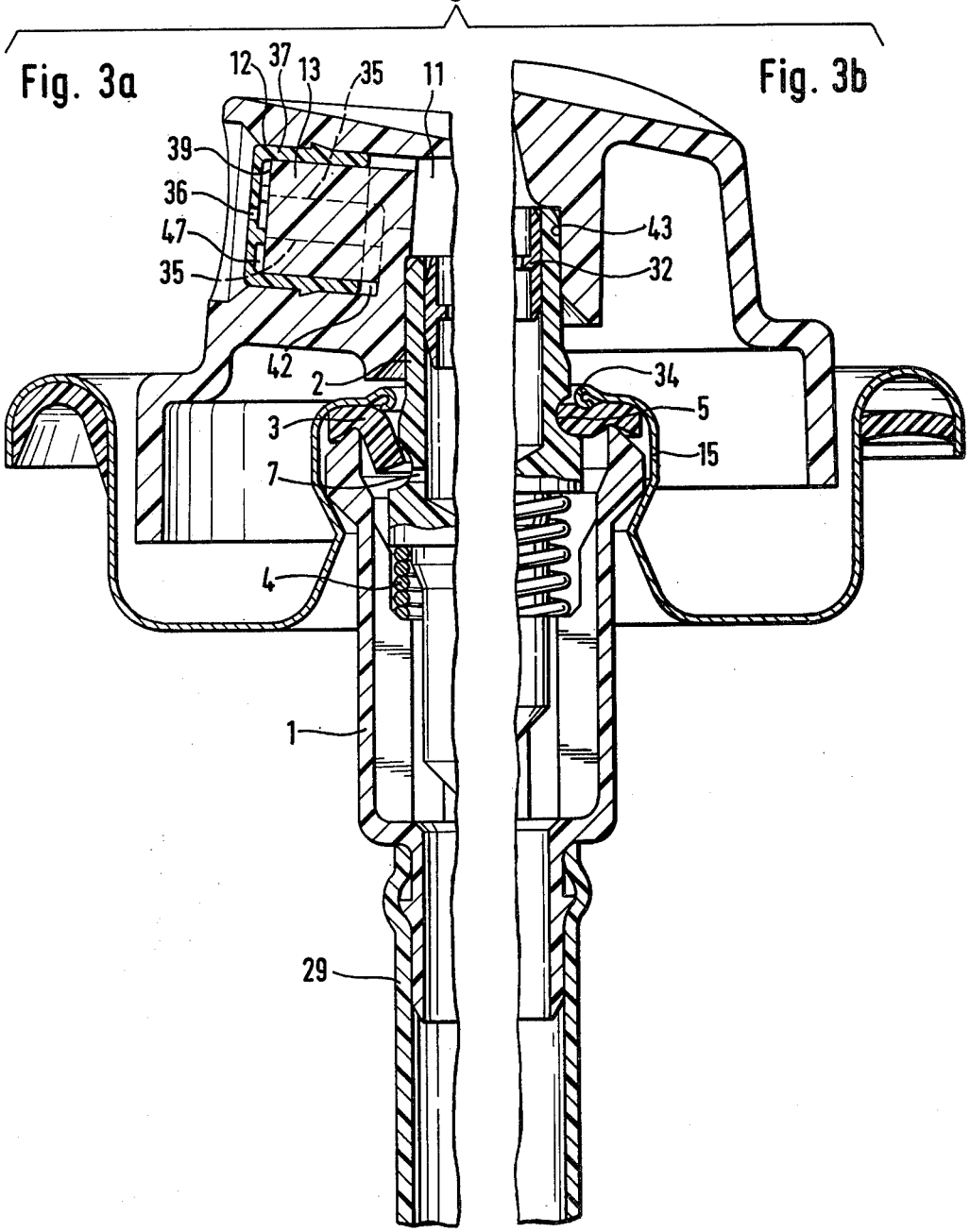
Figure 4:
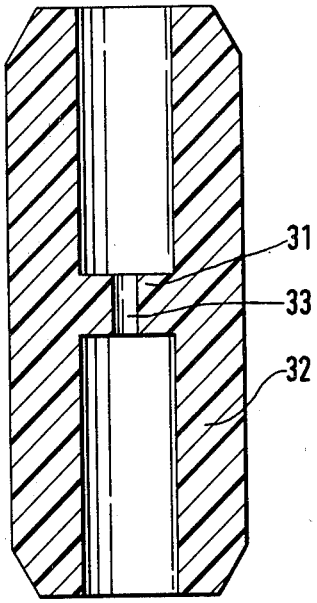
Figure 7:
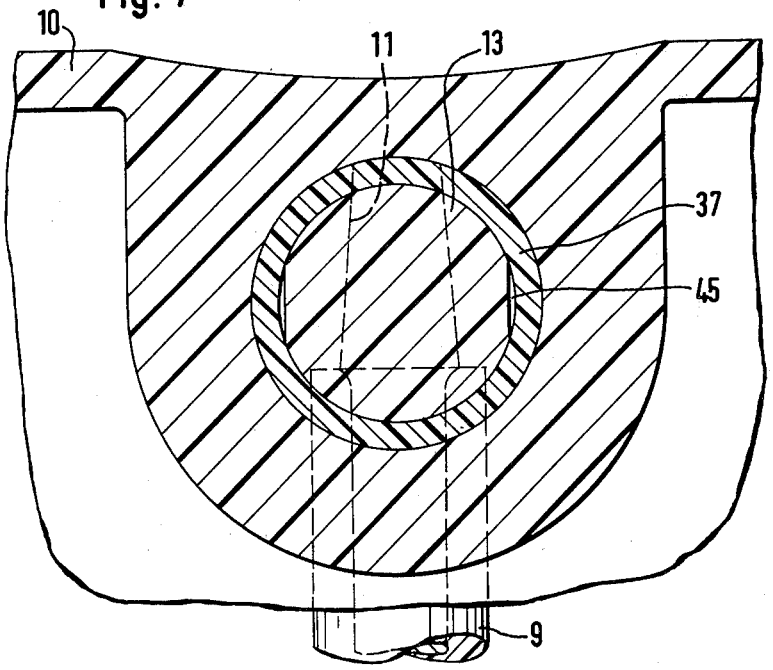
Figure 5:
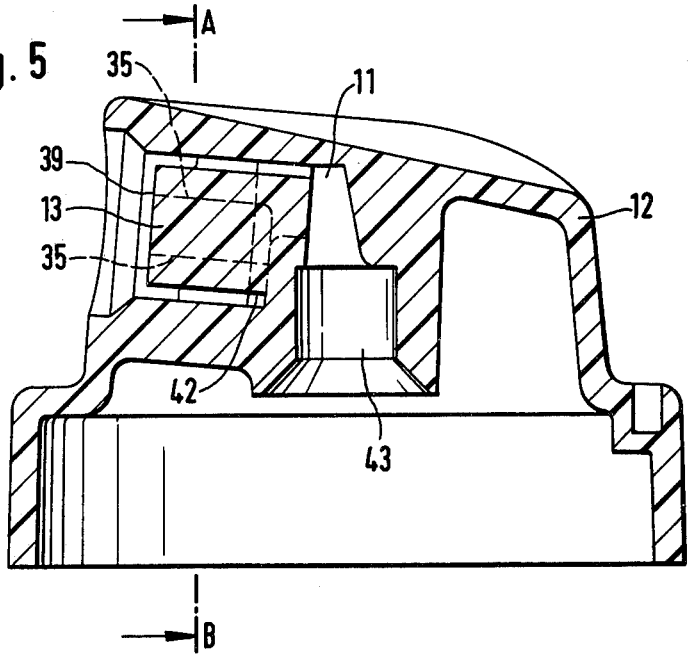
Figure 6:
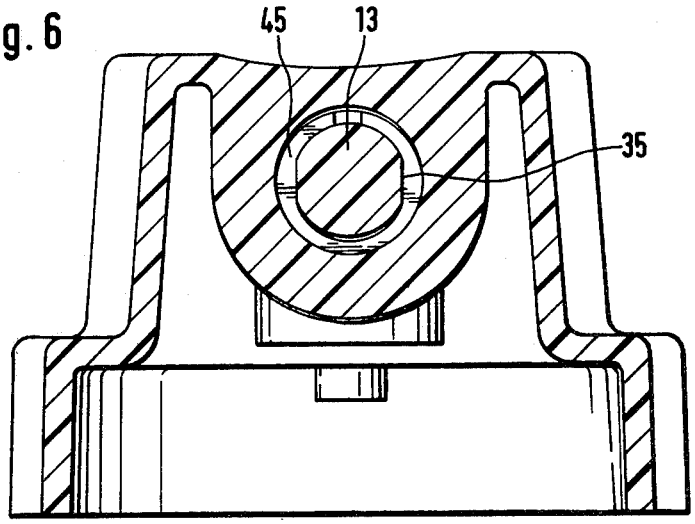
Figure 8:
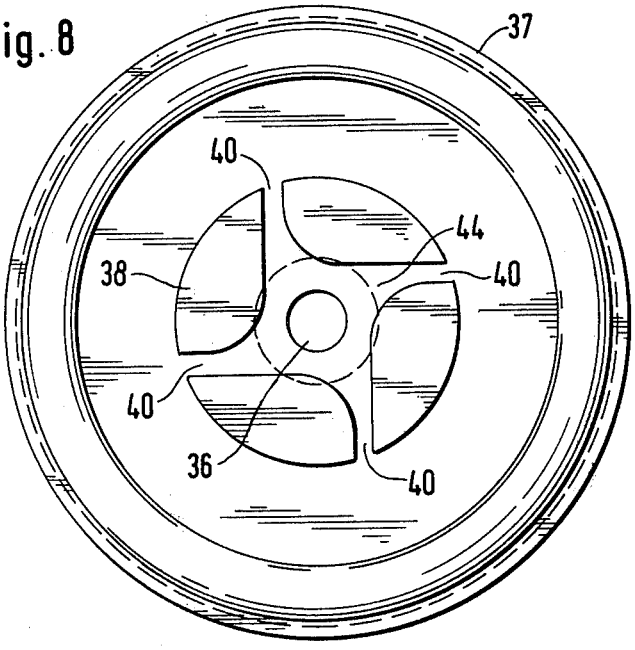
Figure 9:
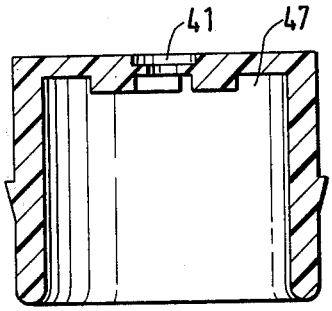
Figure 10:
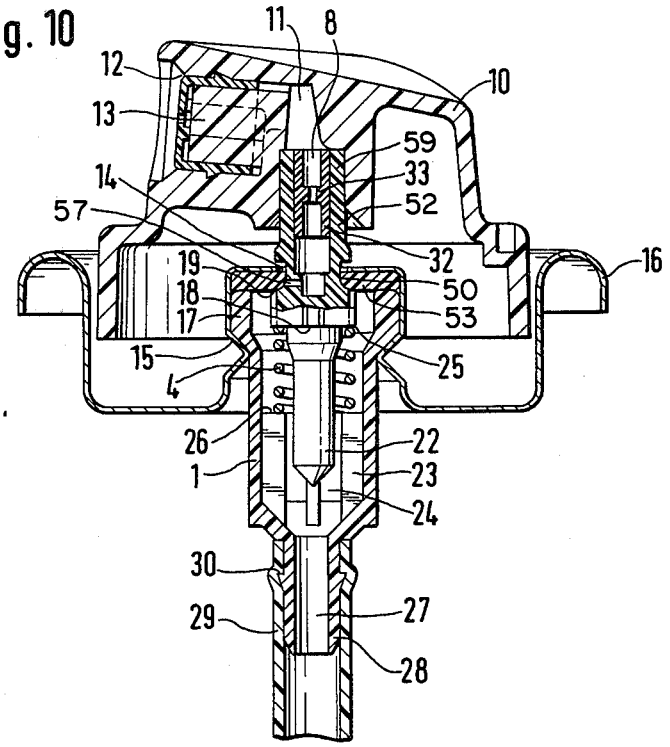
Figure 11:
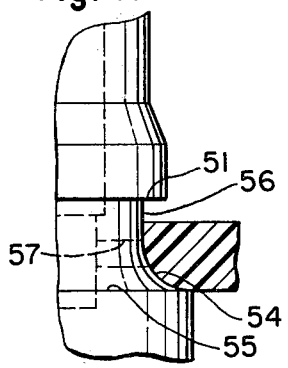
Figure 12:
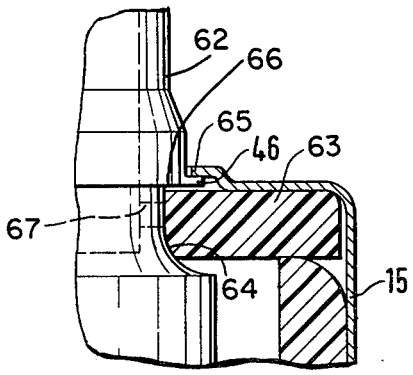
Figure 13:
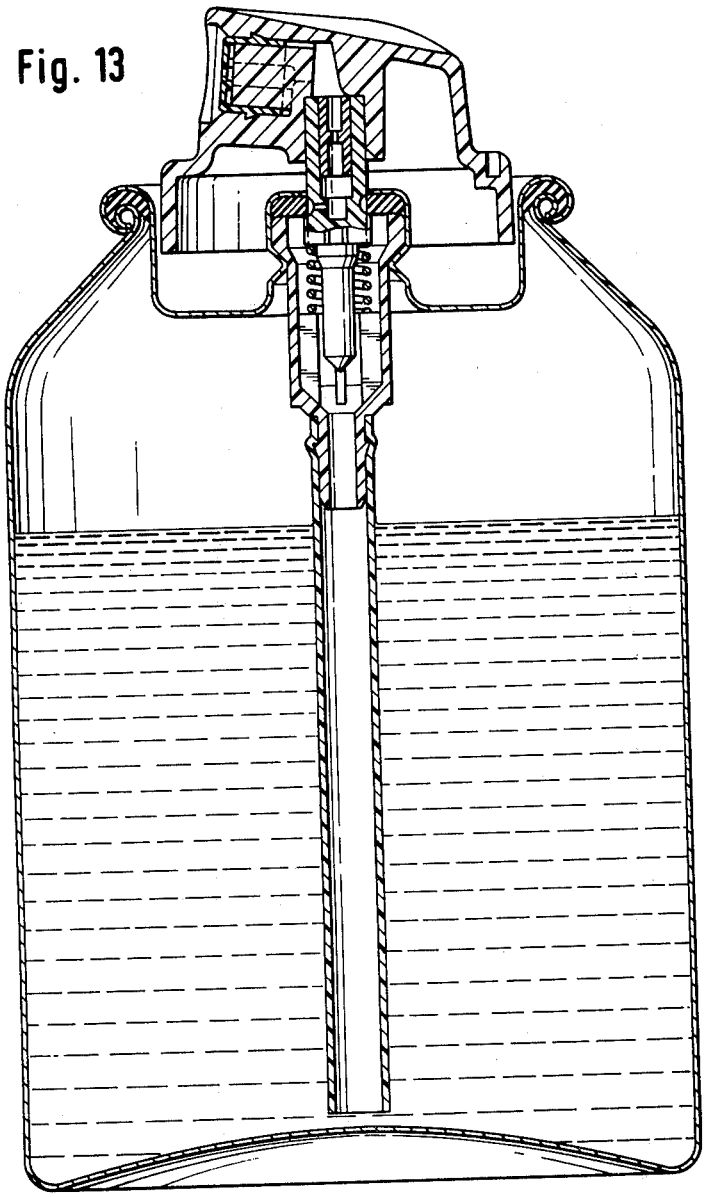

FIG. 3 shows another embodiment of a spray valve in a vertical longitudinal section, the spray valve being in the opened state as shown in FIG. 3*a* in the left-hand half of the longitudinal section and being in the closed state as shown in FIG. 3*b* in the right-hand half of the longitudinal section, FIG. 4 shows a restrictor in a vertical longitudinal section, FIG. 5 shows a vertical longitudinal section of a turbulent-spray head, FIG. 6 shows a vertical longitudinal section through the turbulent-spray head shown in FIG. 5 along the out A-B, FIG. 7 shows a sectional drawing through the jet-receiving plug of the turbulent-spray head, with the jet inserted, FIG. 8 shows a view of the internal bottom of the inserted jet, FIG. 9 shows a vertical longitudinal section through the inserted jet partially shown in FIG. 8, FIG. 10 shows another embodiment of a spray valve in longitudinal section, FIG. 11 is a cut-out from FIG. 10 on an enlarged scale, FIG. 12 shows a modification of the embodiment according to FIG. 10 and FIG. 11, and FIG. 13 shows a longitudinal section of an aerosol spray can which contains a spray valve of the type described in FIGS. 1 to 12 and which is filled with an aerosol preparation.

FIGS. 1 and 2 illustrate a self-closing spray valve for a pressure container, which is not shown, containing an aerosol preparation which comprises a solution of gas/-liquid, for example liquefied propellant gas, which spray valve essentially consists of a housing 1, a valve stem 2, an elastic grommet 3 and a closing spring 4. The valve stem 2 is movable in the direction of opening against the action of the closing compression spring 4 and the elasticity of the grommet. The edge of the hole of the grommet 3 is inserted with a radial bias in an annular groove 5 of the valve stem the greatest width of the groove being about one third greater than the thickness of the grommet. In the closed position of the valve, in FIG. 1, the forces which are simultaneously exerted by the annular groove 5 in the valve stem 2 on the circumferential sections, which are above and below the neutral bending zone, of the hole in the grommet 3 are composed of a force component which is in each case approximately radial to the valve stem 2 and of a force component which is approximately parallel to the axis. Due to the profiled shape of the annular groove, the two force components are here greatest at the upper and lower edge of the hole of the grommet. In the illustrative embodiment in FIGS. 1 and 2, this is achieved by an annular groove which, in transverse profile, has approximately the shape of a circular arc. The profile of the annular groove can, however, also have the shape of a catenary or of a parabola or the like or it can also be shaped in the form of a V. The essential point is merely that, in the zones, facing the container and facing away from the container, of the edge of the hole in the grommet, there is a particularly high specific surface pressure, by means of which an especially good sealing effect is achieved both at the upper inner edge and at the lower inner edge. As a function of the radial bias and the nature of the material for the grommet, an annular space 6 can be formed between the bottom of the annular groove 5 and the cylindrical inner surface of the hole in the grommet. However, even if a highly elastic material, completely filling the groove, is used for the grommet, the intended purpose of an increased specific surface pressure is fulfilled by the decomposition of forces, provided according to the invention, by means of the annular groove at both the upper and the lower edge of the hole.

The annular groove 5 covers at least one radial outlet channel 7 which, in the direction of flow of the solution of gas/liquid, ends in an axial outlet channel 8 of the valve stem 2, which axial outlet channel starts in the zone of the radial outlet channel 7 and is open only towards the outer end.

A turbulent-spray head 10, consisting of plastic, with an inserted turbulence jet 37 is firmly but releasably attached to the valve stem part 9 surrounding the axial outlet channel 8. The turbulent-spray head 10 consists—as can be seen in particular from FIGS. 5 to 9—of the spray head 12 (without jet) with a cylindrical jet-receiving plug 13 which has two surfaces 35 which are parallel to the axis and, as viewed from the jet orifice 36, are vertically arranged. The jet-receiving plug 13 carries the forced-on turbulence jet 37, four raised webs 38 of which rest on the end face 39 of the jet-receiving plug 13. The four webs 38 form an approximately cylindrical turbulence chamber 44 around the jet orifice 36 on the inside of the turbulence jet 37. The webs 38 mutually form the inlet channels 40 which are in a location tangential to the circular jet orifice 36. The webs 38 have a cylindrical outside which is interrupted by the inlet channels 40. A cylindrical recess 41 is located on the outer surface of the turbulence jet 37, concentrically to the jet orifice 36. The turbulent-spray head 10 contains a somewhat eccentrically arranged, tapering chamber 11 which communicates with the annular channel 42 and merges into the receiving opening 43 which is located underneath and is to receive the valve stem part 9. A restrictor 32, which is shown particularly clearly in FIG. 4, in the shape of a cylindrical body with a bore is located in compression in the axial outlet channel 8 of the valve stem part 9. The centrally arranged restricting channel 33 is provided in a bridge member 31 located in the centre of the restrictor 32. The passage orifice 27 has a size of about 2.0 to 3.0 mm, preferably 2.5 mm. The diameter of the radial outlet channel 7 in the valve stem 2 can be about 0.2 to 0.3 mm, preferably 0.25 mm. The restricting channel 33 in the bridge member 31 has a length/diameter (l/d) ratio of 1.0 to 3.0, the diameter being of the order of magnitude of the radial outlet channel 7. The height of the bridge member 31 is approximately one tenth of the length of the restrictor 32, the diameters of the inlet and outlet openings of the restrictor 32 being 0.5 mm to 1.0 mm, preferably 0.8 mm. The passage channel 45 between the jet-receiving plug 13 and the turbulence jet 37, which passage channel is formed by the surfaces 35 on the jet-receiving plug 13 and the inner wall of the turbulence jet 37, has at its maximum point a width of 0.15 to 0.25 mm, preferably 0.20 mm. The length of this passage channel 45 is about 3.5 mm. The front annular channel 47 on the end face 39 of the jet-receiving plug 13 has an external diameter of about 4 mm and an internal diameter which is formed by the cylindrical outline of the webs 38. This internal diameter is 2 to 3 mm and the front annular channel 47 has a channel height which is equal to the web height and specifically is 0.2 to 0.3 mm, preferably 0.25 mm. The inlet channels 40 are 0.15 to 0.30 mm wide and have the height of the webs 38. The turbulence chamber 44 has an approximately cylindrical diameter of 0.70 to 1.30 mm, preferably 0.90 mm. The height of the turbulence chamber 44 is equal to the height of the webs 38. The jet orifice 36 has a length/diameter (l/d)ratio of 0.3 to 1.0, preferably about 0.5, the diameter being 0.3 to 0.6, preferably 0.5, mm. The cylindrical recess 41 has a diameter of about 1 mm and a depth of 0.2 mm.

The outer valve stem part 9 surrounding the axial outlet channel 8 protrudes through a central opening 14 into the dome 15 of a container lid 16. The valve housing 1 is inserted in the dome and its end face, which is chamfered on the outside and faces the central opening 14 in the dome, firmly and tightly clamps the outer edge of the grommet against the inside of the dome by pressing the cylindrical part of the dome in under a part 17, of widened diameter, of the valve housing.

On the side of the annular surface 18, facing the container, an inner guide stem part 22 of greatly reduced diameter is guided to be axially displaceable on guide jaws 23 provided within the valve housing 1. The guide jaws are joined to the inner wall and the bottom of the valve housing 1 and are shaped as relatively narrow ribs. Between them, they enclose interspaces which form connection channels 24 between the interior of the container and the interior of the valve housing.

The two ends of the closing compression spring 4 surrounding the guide stem part 22 are backed up by the end face of the annular surface 18, facing the container, on an annular shoulder 25 and by the end face 26, facing the annular shoulder, of the guide jaws 23 of the valve housing. In the zone of the outer end of the closing compression spring 4, bearing against the annular shoulder 25, the diameter of the inner guide shaft 22 of the valve cone is adapted over a small length approximately to the internal diameter of the closing compression spring, the external diameter of which corresponds approximately to that of the outer valve stem part 9. The main section of the inner guide stem part 22 has a smaller dimension than the internal diameter of the closing compression spring 4, in order to avoid friction between the parts which move relative to one another. Advantageously, the guide jaws 23 also possess, in the zone of their end face 26 facing the closing compression spring, projections which are not shown and surround the outside of the inner end of the closing spring and by means of which the end of the spring is fixed.

In the bottom, the valve housing 1 is provided with a passage orifice 27 which ends in a projection 28, pointing into the container, for a dip tube 29 pushed over the latter. The projection 28 can be provided with a tooth-shaped annular collar 30, by means of which a notch-like connection between the dip tube and the projection 28 is obtained.

The embodiment shown in FIG. 3 is distinguished in that the upper edge of the valve housing 1 is formed obliquely, rising from the outside. The central opening 14 in the dome of the disc has an internal roll 34 located by beading. The outer valve stem part 2 is formed with a smaller diameter, compared with the valve stem 2.

The embodiments shown in FIGS. 10, 11 and 12 differ from the embodiment shown in FIGS. 1 and 2 in that the bottom 56 of the annular groove 50 in the valve stem 52 encloses an approximately right angle with the upper side wall 51 of the groove, facing away from the container and being approximately perpendicular to the main axis of the valve stem. On the side facing the container, the bottom 56 extends conically and radially downwards and outwards. It can be seen from the groove profile according to FIGS. 11 and 12 that the bottom extends cylindrically over approximately the upper third of the width of the groove and then has the shape of a downward circular arc. In place of a line in the form of an exact circular arc, the groove can also run out on the underside in the form of a different arcuate line. The essential point is that, in the zone of the edge 54, facing the container, of the hole in the elastic grommet 53, a particularly great specific surface pressure is achieved in order to obtain a high sealing effect.

In the embodiment according to FIG. 11, it is advantageous to place the radial passage channel 57 in the valve stem 52 likewise into the zone of the annular groove, exposed to the axial and radial force components. Accordingly, the distance between the centre line of the passage channel 57 and the lower line of intersection between the groove ending in the shape of an arc and the cylindrical shell surface of the section of the valve stem 52, located underneath, is about one fifth of the total width of the groove between the line 55 of intersection and the upper axial transverse shoulder 51. In this way, the radial and axial force components, which are caused by the closing force of the compression spring 4 for the purpose of an increased surface pressure in the zone of the radial passage channel 57, are added to the radial bias, under which the grommet engages in the groove.

In the embodiment according to FIG. 12, the valve stem 62 has, in order to determine its closing position accurately even if the grommet 63 is swollen, at least one radially projecting surface 46 immediately above its annular groove, which projecting surface bears, as a stop, against the inside of the dome 15, enclosing the valve housing 1, of a container lid 16. In this case, it would be advisable to place the radial passage channel 67 somewhat higher up since, due to the closing position being always exactly determined, the upper edge of the hole of the grommet 63 is in the vicinity of the upper axial transverse shoulder 66. In order to ensure an accurately plane position of the grommet even in the zone of the edge of its hole, the edge 65, delimiting the opening 14 for the valve stem 2, of the dome 15 of the container lid 16 is pressed upwards during the manufacture of the container lid by the height of the radial projection of the valve cone, forming the abutment surface 65.

In use, the turbulent-spray head 10 is pressed down. As a result, the radial outlet channel 7 which is sealed in the rest position by the elastic grommet 3 is lowered and connected to the free annular space. At the same time, the closing compression spring is compressed and tensioned. The medium which is to be sprayed is forced by the internal pressure in the can through the dip tube 29 and the passage orifice 27 through the connecting channels 24 into the free annular space 20 and flows through the radial outlet channel 7. The expansion in the axial outlet channel 8 of the valve stem 2 effects a formation of vapour, whereby the single-phase mixture is transformed into a two-phase mixture. While the flow proceeds through the restrictor 32, in particular through the restricting channel 33, the mixture is compressed and accelerated, as a result of which the droplet size of the mixture is made finer during the expansion after the restrictor and in the chamber space 11. The mixture which has already been worked into the form of droplets flows from the chamber 11 into the annular channel 42, is divided there into two streams axial to the jet-receiving plug 13 and reaches the inlet channels through the passage channels 45 via the front annular channel. The four inlet channels 40 in turn act as restrictors and at the same time cause a rotary flow of the mixture to be formed in the turbulence chamber. As a result of both the expansion into the turbulence chamber and the diffuser effect of the inlet channels 40, the droplet size of the two-phase mixture is repeatedly reduced. The jet orifice 36 effects a further restriction with a subsequent expansion. The rotation of the flow in the turbulence chamber continues on emergence from the jet orifice 36 and additionally effects a division of the droplets of the two-phase mixture after they have left the orifice. The decisive point for the form of the spray jet is the length/diameter (l/d) ratio of the jet orifice 36 and the geometry of the cylindrical recess 41 located in front thereof.

To achieve the already stated object of the present invention by means of the device described above, those propellant-containing liquid media are indicated as examples in the following text which were felt by the users to be excessively wet on spraying when using hitherto known devices of similar construction.

These examples are based on mixtures which are present as a homogeneous liquid phase in the ready-to-use aerosol can according to FIG. 13 and which have at least 50 percent by weight, preferably at least 55 percent by weight, of non-inflammable constituents, relative to the total weight of the mixture, and which contain, as the propellant gases, carbon dioxide and dimethyl ether and, as the non-inflammable constituents, at least water and carbon dioxide and, if appropriate, methylene chloride and/or 1,1,1-trichloroethane.

A pressurised aerosol preparation in which methylene chloride and/or 1,1,1-trichloroethane are always present, is described first.

Possible organic solvents for the propellant gases to form the propellant and possible solvents for the active ingredients are acetone, ethyl methyl ketone, diethyl ether, dimethoxymethane, diethyl carbonate, ethyl alcohol, n-propanol, iso-propanol, methyl acetate, ethyl acetate, methoxyacetone, hydroxyacetone, methyl isopropyl ketone, diethyl ketone, diisopropyl ketone, dipropyl ketone, diacetonealcohol, dichloroethylene, ethyl chloride, 1,1-dichloroethane and 1-chlorobutane, individually or as a mixture.

In the sense of this invention, non-inflammable constituents are understood to be water, carbon dioxide, methylene chloride and/or 1,1,1-trichloroethane and those other constituents, for example active ingredients, which have an ignition temperature above 600° C.

The preparations according to the invention can be formulated with cosmetic, hygienically or medically active constituents (active ingredients) and yield preparations for diverse purposes, such as, for example, as a cosmetic spray, room spray or medicinal spray.

The active constituents contained in the preparations can, for example, be hair-care substances, hair-spray resin, antiperspirants, deodorants, bactericides, perfume, fungicides, plant extracts and/or organ extracts.

The propellant system used in the preparations according to the invention is based on the propellant gases carbon dioxide and dimethyl ether and on organic solvents as the propellant. The propellant system contains methylene chloride and/or 1,1,1-trichloroethane, as the materials which are soluble in the propellant, as well as water.

An embodiment of the aerosol preparation is characterised in that it contains 4 to 6 percent by weight of carbon dioxide and 6 to 10 percent by weight of dimethyl ether as the propellant gases, the percentages by weight being related to the total weight of the constituents filled in.

Another embodiment of the aerosol preparation is characterised in that it contains 12.9 to 18 percent by weight of water, the percentages by weight being related to the total weight of the constituents filled in.

A further embodiment of the aerosol preparation is characterised in that it contains 32 to 35 percent by weight of methylene chloride and/or 1,1,1-trichloroethane, the percentages by weight being related to the total weight of the constituents filled in.

A further embodiment of the aerosol preparation is characterised in that it contains 33 to 43 percent by weight of organic solvents for propellant gases and active ingredients, the percentages by weight being related to the total weight of the constituents filled in and the pressure in the aerosol container being about 5 to 7 bars.

In a preferred embodiment, the aerosol preparation is characterised in that it contains 12.9 to 17.5 percent by weight of water,
4 to 6 percent by weight of carbon dioxide,
6 to 8 percent by weight of dimethyl ether,
35 to 40 percent by weight of organic solvent,
32 to 35 percent by weight of methylene chloride and/or 1,1,1-trichloroethane and
0.5 to 3.1 percent by weight of active ingredient, wherein the indicated percentages by weight must add up to 100 percent by weight.

The nature and amount of required active ingredient, organic solvent for the propellant gases, solvent for the active ingredients, carbon dioxide, dimethyl ether, water as well as methylene chloride and/or 1,1,1-trichloroethane are, taking into account the intended use, qualitatively and quantitatively matched in a trial batch in such a way, taking into account the ranges of percentages by weight indicated above, that a homogeneous solution is formed as a single phase which can be sprayed perfectly to give a ready-to-use aerosol.

Taking into account the above rules for technical action, the following tolerance range was determined for a specific aerosol preparation according to the invention, which was present as a homogeneous solution and as a single phase and which could be sprayed perfectly:

13.62 to 14.35 percent by weight of water,
4.57 to 4.27 percent by weight of carbon dioxide,
6.95 to 7.76 percent by weight of dimethyl ether,
34.06 to 32.86 percent by weight of iso-propanol and/or ethanol and/or n-propanol,
3.72 to 4.36 percent by weight of acetone and/or methoxyacetone,
35.00 to 33.93 percent by weight of methylene chloride and/or 1,1,1-trichloroethane and
2.08 to 2.47 percent by weight of active ingredients.

The percentages by weight data must here also be selected in such a way that their sum gives 100 percent by weight. In aerosol preparations which were prepared according to the above most preferred embodiment, the content of non-inflammable constituents was 55.02 to 55.33 percent by weight. Compared with the state of the art according to German Offenlegungsschrift No. 2,705,872, Example 2, with a maximum of 40 percent by weight of non-inflammable constituents, this means an advance by a major step-change. For this reason, the aerosol preparations according to the invention are used in transport, storage and application as a product of low accident risk for the intended purpose, so that it can be called a "safety aerosol preparation".

The most preferred embodiment, illustrated above, of the pressurised aerosol preparation is explained in more detail by Examples 1 to 16.

A process for the preparation of a ready-to-use aerosol preparation is characterised in that the active ingredients, water, organic solvents for the propellant gases and solvents for the active ingredients as well as methylene chloride and/or 1,1,1-trichloroethane are processed to give a mixture and a requisite part amount is filled into a pressurised spray container and the pressurized spray container is then closed in such a way that, after dimethyl ether and then carbon dioxide have been filled in under pressure, the liquid filling is present as a single-phase homogeneous solution and the pressure in the pressurised spray container is 5 to 7 bars.

The invention is explained in more detail by the Examples which follow:

EXAMPLE 1

(Hair-spray—aerosol preparation)

The following constituents were used:
A copolymer of N-vinylpyrrolidone and vinyl acetate in a ratio of 30:70 (hair-spray resin): 2.37 g
Water: 13.70 g
Methylene chloride: 34.69 g
iso-propanol: 33.65 g
Acetone: 3.97 g
Dimethyl ether: 6.95 g
Carbon dioxide: 4.57 g
Perfume oil (active ingredient): 0.10 g The hair-spray resin was dissolved in the mixture of methylene chloride, iso-propanol and acetone, perfume oil was added and water was added with stirring. The batch was filled into an aerosol container. A super-fine atomisation valve was used for closing and dimethyl ether was injected through the valve. The indicated amount of carbon dioxide was then passed in.

EXAMPLE 2

(Hair-spray—aerosol preparation)

The following constituents were used:
A copolymer of N-vinylpyrrolidone and vinyl acetate in a ratio of 30:70 (hair-spray resin): 2.47 g
Water: 14.35 g
Methylene chloride: 33.93 g
Ethyl alcohol: 32.86 g
Methoxyacetone: 4.26 g
Dimethyl ether: 7.76 g
Carbon dioxide: 4.27 g
Perfume oil (active ingredient): 0.10 g The hair-spray resin was dissolved in the mixture of methylene chloride, ethyl alcohol and methoxyacetone, perfume oil was added and water was added, while stirring well. The batch was filled into an aerosol container. A superfine atomisation valve was used for closing and dimethyl ether was injected through the valve. The indicated amount of carbon dioxide was then passed in.

EXAMPLE 3

(Hair-spray—aerosol preparation)

The following constituents were used:
A copolymer of N-vinylpyrrolidone and vinyl acetate in a ratio of 30:70 (hair-spray resin): 2.08 g
Water: 13.62 g
1,1,1-trichloroethane: 35.00 g
Iso-propanol: 33.96 g
Acetone: 3.72 g
Dimethyl ether: 6.95 g
Carbon dioxide: 4.57 g
Perfume oil (active ingredient): 0.10 g The hair-spray resin was dissolved in the mixture of 1,1,1-trichloroethane, iso-propanol and acetone, perfume oil was added and water was added, while stirring well. The batch was filled into an aerosol container. A super-fine atomisation valve was used for closing and dimethyl ether was injected through the valve. The indicated amount of carbon dioxide was then passed in.

EXAMPLE 4

(Deodorant spray—aerosol preparation)

The following constituents were used:
2,4,4'-trichloro-2'-hydroxydiphenyl ether (active ingredient): 0.10 g
Benzoic acid ethyl ester (active ingredient): 2.37 g
Water: 14.35 g
1,1,1-trichloroethane: 33.93 g
Iso-propanol: 32.86 g
Acetone: 3.86 g
Dimethyl ether: 7.76 g
Carbon dioxide: 4.27 g
Perfume oil (active ingredient): 0.50 g The active ingredient were dissolved in the mixture of acetone, iso-propanol, 1,1,1-trichloroethane and water. The batch was filled into an aerosol container. A super-fine atomisation valve was used for closing and dimethyl ether was injected through the valve. The indicated amount of carbon dioxide was then passed in.

EXAMPLE 5

(Deodorant spray—aerosol preparation)

The following constituents were used:
2,4,4'-trichloro-2'-hydroxydiphenyl ether (active ingredient): 0.10 g
Benzoic acid ethyl ester (active ingredient): 1.98 g
Water: 13.62 g
1,1,1-trichloroethane: 35.00 g
Ethanol: 33.56 g
Methoxyacetone: 3.72 g
Dimethyl ether: 6.95 g
Carbon dioxide: 4.57 g
Perfume oil (active ingredient): 0.50 g The active ingredients were dissolved in the mixture of methoxyacetone ethyl alcohol, 1,1,1-trichloroethane and water. The batch was filled into an aerosol container. A super-fine atomisation valve was used for closing and dimethyl ether was injected through the valve. The indicated amount of carbon dioxide was then passed in.

EXAMPLE 6

(Room spray—aerosol preparation)

The following constituents were used:
Benzoic acid ethyl ester (active ingredient): 2.08 g
Water: 13.62 g
1,1,1-trichloroethane: 35.00 g
Iso-propanol: 33.06 g
Methoxyacetone: 3.72 g
Dimethyl ether: 6.95 g
Carbon dioxide: 4.57 g
Perfume oil (active ingredient): 1.00 g The active ingredients and the perfume oil were dissolved in the mixture of 1,1,1-trichloroethane, isopropanol, methoxyacetone and water. The batch was filled into an aerosol container. A super-fine atomisation valve was used for closing and dimethyl ether was injected through the valve. The indicated amount of carbon dioxide was then passed in.

EXAMPLE 7

(Hair-spray—aerosol preparation)

The procedure followed was as indicated in Example 1, but the following constituents were used:
A copolymer of N-vinylpyrrolidone and vinyl acetate in a ratio of 30:70 (hair-spray resin): 2.37 g
Methylene chloride: 34.69 g
Iso-propanol: 11.00 g
Ethanol: 11.00 g n-Propanol: 11. 65 g
Acetone: 3.97 g
Dimethyl ether: 6.95 g
Carbon dioxide: 4.57 g
Perfume oil: 0.10 g
Water: 13.70 g

EXAMPLE 8

(Deodorant spray—aerosol preparation)

The procedure followed was as indicated in Example 4, but 1,1,1-trichloroethane was replaced by 33.93 g of methylene chloride. Moreover, the benzoic acid ethyl ester was replaced by the same quantity of diacetone-alcohol.

EXAMPLE 9

(Deodorant spray—aerosol preparation)

The procedure followed was as indicated in Example 4, but the iso-propanol was replaced by 32.86 g of ethanol.

EXAMPLE 10

(Deodorant spray—aerosol preparation)

The procedure followed was as indicated in Example 4, but the 1,1,1-trichloroethane was replaced by a mixture consisting of 3.393 g of 1,1,1-trichloroethane and 30.537 g of methylene chloride.

EXAMPLE 11

(Deodorant spray—aerosol)

The procedure followed was as indicated in Example 4, but a mixture of 16.965 g of methylene chloride and 16.965 g of 1,1,1-trichloroethane was employed instead of 1,1,1-trichloroethane. Instead of iso-propanol, a mixture of 16.43 g of ethanol and 16.43 g of iso-propanol was used.

EXAMPLE 12

(Deodorant spray—aerosol)

The procedure followed was as indicated in Example 5, but the 1,1,1-trichloroethane was replaced by 35.00 g of methylene chloride. Moreover, the benzoic acid ethyl ester was replaced by the same quantity of diacetonealcohol.

EXAMPLE 13

(Deodorant spray—aerosol)

The procedure followed was as indicated in Example 5, but the ethanol was replaced by 33.56 g of iso-propanol.

EXAMPLE 14

(Deodorant spray—aerosol)

The procedure followed was as indicated in Example 5, but the 1,1,1-trichloroethane was replaced by a mixture of 17.5 g of methylene chloride and 17.5 g of 1,1,1-trichloroethane and the ethanol was replaced by a mixture of 16.78 g of iso-propanol and 16.78 g of ethanol.

EXAMPLE 15

(Hair-spray—aerosol preparation)

The procedure followed was as indicated in Example 1, but the acetone was replaced by 3.97 g of ethyl acetate and the methylene chloride was replaced by 34.69 g of 1,1,1-trichloroethane.

EXAMPLE 16

(Room spray—aerosol preparation)

The procedure followed was as indicated in Example 6, but the iso-propanol was replaced by a mixture of 16.53 g of ethanol and 16.53 g of n-propanol.

All the aerosol preparations which have been described in Examples 1 to 16 are present as a homogeneous solution and as a single phase in the container. All the aerosol preparations according to Examples 1 to 16 could readily be sprayed at 20° C. so that the entire content of the can was utilised in accordance with its purpose. The ready-to-use aerosol products according to Examples 1 to 16 have a pressure of about 5 to 7 bars after filling.

Experimental investigations in the manner of spot checks have shown that, in the aerosol preparation according to the invention of approximately the composition 13.62 to 14.35 percent by weight of water,
4.57 to 4.27 percent by weight of carbon dioxide,
6.95 to 7.76 percent by weight of dimethyl ether,
37.78 to 37.22 percent by weight of organic solvents,
35.00 to 33.93 percent by weight of methylene chloride and/or 1,1,1-trichloroethane and
2.08 to 2.47 percent by weight of active ingredients, wherein the percentage of weight data must add up to 100% by weight, taking into account the intended purpose when testing trial batches in which a homogeneous solution is formed as the single phase and which could be sprayed perfectly, the following organic solvents can also be used individually up to the following quantities, by way of example:

3.72–4.36 percent by weight of acetone,
up to 4.36 percent by weight of ethyl acetate only in combination with 1,1,1-trichloroethane,
1.98–2.37 percent by weight of diacetone-alcohol,
up to 4.36 percent by weight of dimethoxymethane only in combination with 1,1,1-trichloroethane,
3.72–4.36 percent by weight of hydroxyacetone,
3.72–4.36 percent by weight of methoxyacetone,
up to 4.36 percent by weight of methyl acetate only in combination with 1,1,1-trichloroethane,
up to 4.36 percent by weight of methyl ethyl ketone only in combination with 1,1,1-trichloroethane, and
up to 4.36 percent by weight of methyl isopropyl ketone only in combination with 1,1,1-trichloroethane.

Further spot check tests have shown that mixtures of hydroxyacetone and methoxyacetone can also be useful in the range from 3.72 to 4.36 percent by weight.

EXAMPLE 17

A hair-spray is prepared. For this purpose, 2.37 g of a copolymer of N-vinylpyrrolidone and vinyl acetate in a weight ratio of 30:70,
0.10 g of perfume oil,
33.65 g of iso-propanol,
13.70 g of water and,
3.97 g of acetone are dissolved and filled into a suitable aerosol container. The aerosol container is provided with a spray valve according to FIG. 1 or FIG. 3 or FIG. 10, but without the turbulent-spray head 10. Subsequently, 41.64 g of a dimethyl ether/methylene chloride solution (16.7% by weight of dimethyl ether and 83.3% by weight of methylene chloride) and 4.57 g of carbon dioxide are injected through the spray valve into the aerosol container. A turbulent-spray head 10 is then placed onto the spray valve. The filled aerosol can is illustrated by FIG. 13.

Due to the use of an aerosol preparation and of a device according to the invention, the spray properties of this aerosol filling largely correspond to the properties of corresponding hair-sprays which have been formulated with the use of fluorochlorohydrocarbon propellants.

EXAMPLE 18

A hair-spray is prepared. For this purpose, 2.47 g of a copolymer of N-vinylpyrrolidone and vinyl acetate in a weight ratio of 30:70,
0.1 g of perfume oil,
32.86 g of ethanol,
14.35 g of water and
4.26 g of methoxyacetone are dissolved and filled into a suitable aerosol container. The aerosol container is provided with a spray valve according to FIG. 1 or FIG. 3 or FIG. 10, but without the turbulent-spray head 10. Subsequently, 41.69 g of a dimethyl ether/methylene chloride solution (18.6% by weight of dimethyl ether and 81.4% by weight of methylene chloride) and 4.27 g of carbon dioxide are injected through the spray valve into the aerosol container. A turbulent-spray head 10 is then placed onto the spray valve. The filled aerosol container is illustrated by FIG. 13.

Due to the use of an aerosol preparation and of a device according to the invention, the spray properties of this aerosol filling largely correspond to the properties of corresponding hair-spray products which have been formulated with the use of fluorochlorohydrocarbon propellants.

EXAMPLE 19

A hair-spray is prepared. For this purpose, 2.08 g of a copolymer of N-vinylpyrrolidone and vinyl acetate in a volume ratio of 70:30,
0.1 g of perfume oil,
33.96 g of iso-propanol,
13.62 g of water and
3.72 g of acetone are dissolved and filled into a suitable aerosol container. The aerosol container is provided with a spray valve according to FIG. 1 or FIG. 3 or FIG. 10, but without the turbulent-spray head 10. Subsequently, 41.65 g of a dimethyl ether/1,1,1-trichloroethane solution 16.6% by weight of dimethyl ether and 83.4% by weight of 1,1,1-trichloroethane) and 4.57 g of carbon dioxide are injected through the spray valve into the aerosol container. A turbulent-spray head 10 is then applied onto the spray valve. The filled aerosol container is illustrated by FIG. 13.

Due to the use of an aerosol preparation and of a device according to the invention, the spray properties of this aerosol filling largely correspond to the properties of corresponding hair-spray products which have been formulated with the use of fluorochlorohydrocarbon propellants.

EXAMPLE 20

A deodorant spray is prepared. For this purpose, 0.10 g of 2,4,4'-trichloro-2'-hydroxydiphenyl ether,
2.37 g benzoic acid ethyl ester,
14.35 g of water,
32.86 g of iso-propanol,
3.86 g of acetone and
0.50 g of perfume oil are dissolved and filled into a suitable aerosol container. The aerosol container is provided with a spray valve according to FIG. 1 or FIG. 3 or FIG. 10, but without the turbulent-spray head 10. Subsequently, 41.69 g of a dimethyl ether/1,1,1-trichloroethane solution 18.6% by weight of dimethyl ether and 81.4% by weight of 1,1,1-trichloroethane) and 4.27 g of carbon dioxide are injected through the spray valve into the aerosol container. The turbulent-spray head 10 is then placed onto the spray valve. The filled aerosol can is illustrated by FIG. 13.

Due to the use of an aerosol preparation and of a device according to the invention, the spray properties of this aerosol filling largely correspond to the properties of corresponding deodorant spray products which have been formulated with the use of fluorochlorohydrocarbon propellants.

EXAMPLE 21

A deodorant spray is prepared. For this purpose, 0.10 g of 2,4,4'-trichloro-2'-hydroxyphenyl ether,
1.98 g of benzoic acid ethyl ester
13.62 g of water,
33.56 g of ethanol,
3.72 g of methoxyacetone and
0.50 g of perfume oil are dissolved and filled into a suitable aerosol container. The aerosol container is provided with a spray valve according to FIG. 1 or FIG. 3 or FIG. 10, but without the turbulent-spray head 10. Subsequently, 41.95 g of a dimethyl ether/1,1,1-trichloroethane solution (16.6% by weight of dimethyl ether and 83.4% by weight of 1,1,1-trichloroethane) and 4.57 g of carbon dioxide are injected through the spray valve into the aerosol container. A turbulent-spray head 10 is then placed onto the spray valve. The filled aerosol can is illustrated by FIG. 13.

Due to the use of an aerosol preparation and of a device according to the invention, the spray properties of this aerosol filling largely correspond to the properties of corresponding deodorant spray products which have been formulated with the use of fluorochlorohydrocarbon propellants.

In the above Examples 1–2 and the further investigations, an aerosol can according to FIG. 13 was used, which was provided with a spray valve according to FIG. 1 or FIG. 3 or FIG. 10.

The technical advance achieved by the homogeneous filling present in the aerosol can according to FIG. 13 is indicated in Table I which follows, in comparison with the aerosol preparations according to German Offenlegungsschrift No. 2,705,872.

Subsequently, a pressurized carrier mixture for aerosol preparations is described, which is likewise based on the propellants dimethyl ether and carbon dioxide, but which does not contain methylene chloride or 1,1,1-trichloroethane.

TABLE I

Comparative data for the non-inflammable constituents in the aerosol preparation, to prove the technical advance achieved, taking into account German Offenlegungsschrift 2,705,872

| Example No. | 1 | 2 | 3 | 4 | 5 | 6 | 7 | 8 | 9 | 10 |
|---|---|---|---|---|---|---|---|---|---|---|
| State of the art in German Offenlegungsschrift 2,705,872, non-inflammable constituents in per cent by weight | 37 | 40 | 38 | 36 | 31 | 25 | 18 | 35.2 | 35.2 | 25 |
| Aerosol preparation according to the invention, non-inflammable constituents in per cent by weight | 55.33 | 55.02 | 55.27 | 55.02 | 55.27 | 55.28 | 55.33 | 55.02 | 55.02 | 55.02 |

In calculating the comparative data for the non-inflammable constituents, the following components were taken into account:

hair-spray resin, methylene chloride, water, carbon dioxide, 2,4,4'-trichloro-2'-hydroxydiphenyl ether, 1,1,1-trichloroethane and benzoic acid ethyl ester.

The aluminum chlorohydroxide/propylene glycol complex contained in Example 10 of German Offenlegungsschrift No. 2,705,872 was assumed to be non-inflammable to the extent of 50 percent by weight.

The above comparative data show that the present invention provides an aerosol preparation which is improved by a major step-change since, according to the state of the art, 40 percent by weight of non-inflammable constituents are contained, in the most favourable case, in the aerosol preparation free from fluorohydrocarbons, whilst the content of non-inflammable constituents is at least 55.02 percent by weight in all the examples in the aerosol preparation according to the invention.

The subject of the invention is a pressurised carrier mixture for aerosol preparations of a self-propelling spray system for use as a universal spray based on active ingredients which are to be administered, organic solvents, water and propellants in a spray container according to FIGS. 1–13, so that the carrier mixture is present as a homogeneous solution and the latter contains 70.0–50.1 percent by weight of water,
38.5–28.7 percent by weight of dimethyl ether,
0.5–10.0 percent by weight of iso-propanol and/or ethanol and/or n-propanol and
1.4–0.8 percent by weight of carbon dioxide wherein the percentage by weight data must add up to 100 percent by weight.

In the sense of this invention, non-inflammable constituents are understood to be water, carbon dioxide and those other constituents, for example active ingredients, which have an ignition temperature device above 600° C.

The carrier mixtures, according to the invention, of the aerosol preparations can be formulated with cosmetic or hygienically or medically active constituents (active ingredients) and give preparations for diverse purposes, for example as a cosmetic spray, room spray or medicinal spray, preferably as a deodorant spray.

The active constituents can, for example, be hair-care substances, hair-spray resin, antiperspirants, deodorants, bactericides, perfume, fungicides, plant extracts and/or organ extracts.

The aqueous carrier mixture used in the aerosol preparations according to the invention is based on the propellant gases carbon dioxide and dimethyl ether as the propellant.

An embodiment of the carrier mixture is characterised in that it contains 0.8–1.1 percent by weight of carbon dioxide and 28.7–38.5 percent by weight of dimethyl ether as the propellant gases, the percentages by weight relating to the total weight of the aqueous carrier mixture.

Another embodiment of the carrier mixture is characterised in that it contains 54.0–70.0 percent by weight of water, the percentages by weight relating to the total weight of the aqueous carrier mixture.

A further embodiment of the carrier mixture is characterised in that it contains 5.0–10.0 percent by weight of alcohols having 2 and/or 3 C atoms, the percentages by weight relating to the total weight of the aqueous carrier mixture.

A particularly preferred embodiment of the carrier mixture is characterised in that the carrier mixture contains 54.0–55.0 percent by weight of water,
0.9–1.1 percent by weight of carbon dioxide,
38.5–35.1 percent by weight of dimethyl ether and
9.0–6.4 percent by weight of alcohols having 2 and/or 3 C atoms, wherein the indicated percentages by weight must add up to 100 percent by weight.

In the preparation of the carrier mixture or the aerosol preparations according to the invention, the nature and amount of required active ingredient, alcohols of the stated types, carbon dioxide, dimethyl ether as well as water are, taking into account the intended use, qualitatively and quantitatively matched in a trial batch is such a way, taking into account the ranges of percentages by weight indicated above, that a homogeneous solution is formed as a single phase which can be sprayed perfectly to give a ready-to-use aerosol.

In the carrier mixtures prepared for aerosol preparations of the above particularly preferred embodiment, the content of non-flammable constituents was 55.1–55.9 percent by weight. Compared with the state of the art according to German Offenlegungsschrift No. 2,705,872, Example 2, with a maximum of 40 percent by weight of non-inflammable constituents, this means an advance by a major step-change. For this reason, the aerosol preparations according to the invention are used in transport, storage and application as a product of low accident risk for the intended purpose, so that it can be called a "safety aerosol preparation".

TABLE II

Examples of carrier mixtures according to the invention, which form a homogeneous liquid phase

| | A | B | C | D | E | F | G | H | I | J |
|---|---|---|---|---|---|---|---|---|---|---|
| Constituents | % by weight | % by weight | % by weight | % by weight | % by weight | % by weight | % by weight | % by weight | % by weight | % by weight |
| Water | 70.0 | 70.0 | 70.0 | 54.0 | 54.0 | 54.0 | 54.0 | 54.70 | 54.0 | 54.42 |
| Dimethyl ether | 28.7 | 28.7 | 28.7 | 35.0 | 35.0 | 38.5 | 38.0 | 35.71 | 35.0 | 37.56 |
| Iso-propanol | 0.5 | | | 10.0 | | | 7.0 | | | 6.92 |
| Ethanol | | | 0.5 | | 10.0 | 6.5 | | 8.57 | 10.0 | |
| n-propanol | | 0.5 | | | | | | | | |
| Carbon dioxide | 0.8 | 0.8 | 0.8 | 1.0 | 1.0 | 1.0 | 1.0 | 1.02 | 1.0 | 1.10 |
| Pressure in bar | 6.8 | 6.9 | 7.0 | 5.5 | 6.3 | 5.7 | 5.7 | 6.4 | 6.3 | 5.7 |

| | K | L | M |
|---|---|---|---|
| Constituents | % by weight | % by weight | % by weight |
| Water | 54.0 | 54.0 | 54.0 |
| Dimethyl ether | 35.0 | 38.0 | 38.5 |
| Iso-propanol | 1.0 | 6.0 | |
| Ethanol | 8.0 | | 5.5 |
| n-propanol | 1.0 | 1.0 | 1.0 |
| Carbon dioxide | 1.0 | 1.0 | 1.0 |
| Pressure in bar | 6.0 | 5.7 | 5.7 |

The carrier mixtures according to the invention have a pressure of about 5 to about 7 bars at 20° C.

EXAMPLE 22

A hair-care product is prepared analogously to the carrier mixture J indicated in Table II. For this purpose,
0.80 g of polyvinylpyrrolidone,
0.10 g of perfume oil and
6.86 g of iso-propanol
are filled into a suitable aerosol container. The aerosol container is provided with a spray valve according to FIG. 1 or FIG. 3 or FIG. 10, but without the turbulent-spray head 10. Subsequently, 77.04 g of aqueous dimethyl ether solution (30% by weight of dimethyl ether and 70% by weight of water), 14.11 g of dimethyl ether and 1.09 g of carbon dioxide are injected through the spray valve into the aerosol container. A turbulent-spray head 10 is then placed onto the spray valve. The filled aerosol can is illustrated by FIG. 13.

Due to the use of a carrier mixture and of a device according to the invention, the spray properties of this aerosol filling largely correspond to the properties of corresponding hair-care products which have been formulated with the use of fluorochlorohydrocarbon propellants.

EXAMPLE 23

A deodorant spray preparation according to the following formulation is prepared analogously to the carrier mixture H indicated in Table II:
98.00% by weight of carrier mixture H,
0.10% by weight of a bactericide for deodorant spray,
0.50% by weight of perfume oil,
0.30% by weight of a solubiliser and
1.10% by weight of a superfatting agent for deodorant spray.

For this purpose,
0.10 g of bactericide for deodorant spray,
0.50 g of perfume oil,
0.30 g of a solubiliser and
1.10 g of a superfatting agent for deodorant spray are dissolved in 8.40 g of ethanol and filled into a suitable aerosol container. The aerosol container is provided with a spray valve according to FIG. 1 or FIG. 3 or FIG. 10, but without the turbulent-spray head 10. Subsequently, 76.57 g of aqueous dimethyl ether solution (30% by weight of dimethyl ether and 70% by weight of water), 12.03 g of dimethyl ether and 1.00 g of carbon dioxide are injected through the spray valve into the aerosol container. The turbulent-spray head 10 is then placed onto the spray valve. The filled aerosol can is illustrated by FIG. 13.

Due to the use of a carrier mixture and of a device according to the invention, the spray properties of this aerosol filling largely correspond to the properties of corresponding deodorant spray products which have been formulated with the use of fluorochlorohydrocarbon propellants.

EXAMPLE 24

An antiperspirant spray preparation having the following formulation is prepared analogously to the carrier mixture I indicated in Table II:
96.7% by weight of carrier mixture I,
3.0% by weight of a perspiration inhibitor and
0.3% by weight of perfume oil.

For this purpose,
3.0 g of a perspiration inhibitor,
0.3 g of perfume oil,
10.0 g of water and
9.67 g of ethanol
are dissolved and filled into a suitable aerosol container. The aerosol container is provided with a spray valve according to FIG. 1 or FIG. 3 or FIG. 10, but without the turbulent-spray head 10. Subsequently, 60.31 g of aqueous dimethyl ether solution (30% by weight of dimethyl ether and 70% by weight of water), 15.75 g of dimethyl ether and 0.97 g of carbon dioxide are injected through the spray valve into the aerosol container. A turbulent-spray head 10 is then placed onto the spray valve. The filled aerosol can is illustrated by FIG. 13.

Due to the use of a carrier mixture and of a device according to the invention, the spray properties of this aerosol filling largely correspond to the properties of corresponding antiperspirant spray products which have been formulated with the use of fluorochlorohydrocarbons as the propellant.

Further investigations have shown that, as a result of the appropriate addition of active ingredients and conventional additives, the carrier mixtures H and I in Table I are outstandingly suitable for the manufacture of aerosol preparations for toiletries, hair-care requisites, household articles, medicinal sprays, technical aerosols and perfume-atomising agents.

EXAMPLE 25

A deodorant spray preparation according to the following formulation is prepared analogously to the carrier mixture H indicated in Table II:

98.00% by weight of carrier mixture H,
0.10% by weight of a bactericide for deodorant spray,
0.50% by weight of perfume oil,
0.30% by weight of a solubiliser and
1.10% by weight of a superfatting agent for deodorant spray.

For this purpose, 0.10 g of a bactericide for deodorant spray,
0.50 g of perfume oil,
0.30 g of a solubiliser and
1.10 g of a superfatting agent for deodorant spray are filled into a suitable aerosol container. The aerosol container is provided with a spray valve according to FIG. 1 or FIG. 3 or FIG. 10, but without the turbulent-spray head 10. Subsequently, 97.00 g of a single-phase aqueous-alcoholic dimethyl ether solution (36.08% by weight of dimethyl ether, 55.26% by weight of water and 8.66% by weight of ethanol) and 1.00 g of carbon dioxide are injected through the spray valve into the aerosol container. The turbulent-spray head 10 is then placed onto the spray valve. The filled aerosol can is illustrated by FIG. 13.

Due to the use of a carrier mixture and of a device according to the invention, the spray properties of this aerosol filling largely correspond to the properties of corresponding deodorant spray products which have been formulated with fluorochlorohydrocarbons as the propellant.

EXAMPLE 26

An antiperspirant spray preparation having the following formulation is prepared analogously to the carrier mixture I indicated in Table II:

96.70% by weight of carrier mixture I,
3.00% by weight of a perspiration inhibitor and
0.30% by weight of perfume oil.

For this purpose, 3.0 g of a perspiration inhibitor and
0.3 g of perfume oil are filled into a suitable aerosol container. The aerosol container is provided with a spray valve according to FIG. 1 or FIG. 3 or FIG. 10, but without the turbulent-spray head 10. Subsequently, 95.73 g of a single-phase aqueous-alcoholic dimethyl ether solution (35.35% by weight of dimethyl ether, 54.55% by weight of water and 10.10% by weight of ethanol) and 0.97 g of carbon dioxide are injected through the spray valve into the aerosol container. A turbulent-spray head 10 is then placed onto the spray valve. The filled aerosol can is illustrated by FIG. 13.

Due to the use of a carrier mixture and of a device according to the invention, the spray properties of this aerosol filling largely correspond to the properties of corresponding antiperspirant spray products which have been formulated with fluorochlorohydrocarbons as the propellant.

EXAMPLE 27

A hair-care product is prepared analogously to the carrier mixture J indicated in Table II. For this purpose, 0.80 g of polyvinylpyrrolidone and
0.10 g of perfume oil are filled into a suitable aerosol container. The aerosol container is provided with a spray valve according to FIG. 1 or FIG. 3 or FIG. 10, but without the turbulent-spray head 10. Subsequently, 98.01 g of a single-phase aqueous/iso-propyl alcoholic dimethyl ether solution (37.98% by weight of dimethyl ether, 55.02% by weight of water and 7.00% by weight of iso-propyl alcohol) and 1.09 g of carbon dioxide are injected through the spray valve into the aerosol container. A turbulent-spray head 10 is then placed onto the spray valve. The filled aerosol can is illustrated by FIG. 13.

Due to the use of a carrier mixture and of a device according to the invention, the spray properties of this aerosol filling largely correspond to the properties of corresponding hair-care products which have been formulated with the use of fluorochlorohydrocarbon propellants.

EXAMPLE 28

The formulation according to the data in Example 25 is prepared but—differing from that Example—the indicated quantity of bactericide, perfume oil, solubiliser and superfatting agent is dissolved beforehand, in a mixing tank, in the carrier mixture H which is still free from carbon dioxide. The mixture is then injected into an aerosol container which is provided with a spray valve placed thereon, but without the turbulent-spray head 10. Thus, the mixture is injected through the spray valve into the aerosol container. Subsequently, the indicated quantity of carbon dioxide is injected through the spray valve into the aerosol container. The turbulent-spray head 10 is then placed onto the spray valve.

The spray properties of this aerosol filling correspond to those of the filling according to Example 25.

EXAMPLE 29

The formulation according to the data in Example 26 is prepared. Differing from the latter, however, the procedure indicated in Example 28 is followed.

The spray properties of this aerosol filling correspond to those of the filling according to Example 26.

EXAMPLE 30

The formulation according to the data in Example 26 is prepared. Differing from the latter, however, the procedure indicated in Example 28 is followed.

The spray properties of this aerosol filling correspond to those of the filling according to Example 26.

In the above Examples 2,4,4′-trichloro-2′-hydroxyphenyl ether, for example, can be used as the bactericide for deodorant spray. In the above Examples, castor oil which has been hydrogenated and ethoxylated with about 40 mols of ethylene oxide per mol can, for example, be employed as the solubiliser for deodorant spray. The superfatting agent for deodorant spray used in the above Examples can, for example, be polyethylene glycol having an average molecular weight of 400. The perspiration inhibitor employed in the above Examples can, for example, be aluminium hydroxychloride.

TABLE III

Comparative data for the non-inflammable constituents in the aerosol preparation or carrier mixture, to prove the technical advance achieved, taking into account German Offenlegungsschrift 2,705,872

| Example No. | 1 | 2 | 3 | 4 | 5 | 6 | 7 | 8 | 9 | 10 |
|---|---|---|---|---|---|---|---|---|---|---|
| State of the art, German Offenlegungsschrift 2,705,872, non-inflammable constituents in per cent by weight | 37 | 40 | 38 | 36 | 31 | 25 | 18 | 35.2 | 35.2 | 25 |
| Carrier mixtures according to the | A | B | C | D | E | F | G | H | I | J |
| invention, non-inflammable constituents in per cent by weight | 70.8 | 70.8 | 70.8 | 55.0 | 55.0 | 55.0 | 55.0 | 55.72 | 55.0 | 55.52 |
| Example No. | 22 | 23 | 24 | 25 | 26 | 27 | 28 | 29 | 30 | |
| Aerosol preparations made from the carrier mixture according to the invention | 55.82 | 55.0 | 56.19 | 55.0 | 56.19 | 55.82 | 55.0 | 56.19 | 55.82 | |

When calculating the comparative data for the non-inflammable constituents, the following components were taken into account: 1. According to German Offenlegungsschrift No. 2,705,872: hair-spray resin, methylene chloride, water and 1,1,1-trichloroethane; the aluminiumchlorohydroxide/propyleneglycol complex contained in Example 10 was assumed to be non-inflammable to the extent of 50% by weight. 2. According to the present invention: hair-spray resin, water, carbon dioxide, bactericide, perspiration inhibitor and solubiliser. The above comparative data show that the present invention provides carrier mixtures or aerosol preparations which are improved by a major step-change since, according to the state of the art, 40% by weight of noninflammable constituents are contained, in the most favourable case, in the aerosol preparation free from fluorochlorohydrocarbons, whilst the content of non-inflammable constituents is in all the examples at least 55% by weight in the carrier mixture according to the invention.

We claim:

1. A self closing super-fine atomizing spray valve for an aerosol can to discharge a homogeneous solution acting as a propellant filling comprising a valve housing mounted in said can and providing communication between the interior and exterior of said can, a valve stem axially movable within said housing between valve open and valve closed positions, a compression spring in said housing and bearing against a portion of said housing for urging said valve stem towards said valve closing position, said valve stem having an annular groove defining upper and lower shoulders and an axial outlet channel communicating to the interior of said can by means of a radial outlet opening at said groove, an elastic annular grommet having an external edge clamped between said valve housing and a dome on said can and an internal cylindrical edge engaging and radially biasing said annular groove of said valve stem to seal said radial outlet when said valve is in its closed position, said internal cylindrical edge of said grommet having upper and lower zones tightly engaging said upper and lower shoulders of said valve stem respectively through radial and axial forces, which are at a maximum at said zones, under the influence of said spring when said valve is in its closed position, a restrictor compression-mounted in said axial outlet channel of said valve stem having an axial cylindrical restricting channel, a bridge member in said restricting channel and an orifice in said bridge member, a turbulent spray head having a receiving opening for firmly but releasably mounting on said valve stem, an approximately eccentrically arranged tapering chamber communicating with said receiving opening, and a substantially cylindrical plug provided with two surfaces substantially parallel to said valve stem and an end surface, and a turbulence jet forced on said plug having a jet orifice, four raised webs on an inner surface of said turbulence jet contacting said end surface of said plug, said four webs being arranged to form an approximately cylindrical turbulence chamber and inlet channels tangential to said jet orifice, and a cylindrical recess located on an outer surface of said turbulence jet concentric with said jet orifice.

2. A spray valve according to claim 1, further comprising a passage orifice in said valve housing having a diameter of about 2.0 to about 3.0 mm, wherein the diameter of the radial outlet opening in the valve stem is about 0.2 to about 0.3 mm and the orifice in the bridge member of the restrictor has a length/diameter ratio of 1.0 to 3.0, the diameter of the restricting orifice being of the order of magnitude of the radial outlet opening.

3. A spray valve according to claim 2, wherein the length of the bridge member is approximately one tenth of the length of the restrictor, and further comprising inlet and outlet openings of the restrictor having a diameter of 0.5 to 1.0 mm.

4. A spray valve according to one of claims 1 to 3, further comprising passage channels between the substantially cylindrical plug and the turbulence jet formed by the surfaces on the plug and an inner wall of the turbulence jet, having at their maximum point a width of about 0.15 mm to about 0.25 mm and a length of about 3.5 mm, and a front annular channel adjacent the end surface of the plug having an external diameter of about 4 mm and an internal diameter, formed by the cylindrical outline of the webs, of about 2 to about 3 mm and a channel height of about 0.2 to about 0.3 mm, which height is approximately equal to the web height, and the inlet channels are about 0.15 to about 0.30 mm wide and have the height of the webs.

5. A spray valve according to claim 4, wherein the turbulence chamber has an approximately cylindrical diameter of about 0.70 to about 1.30 mm and a height equal to the height of the webs, and the jet orifice has a length/diameter ratio of about 0.3 to about 1.0, the diameter being about 0.2 to about 0.6 mm and the cylindrical recess having a diameter of about 1 mm and a depth of about 0.2 mm.

6. A spray valve according to claim 1, wherein the turbulence chamber has an approximately cylindrical diameter of about 0.70 to about 1.30 mm and a height equal to the height of the webs, and the jet orifice has a length/diameter ratio of about 0.3 to about 0.6 and the cylindrical recess having a diameter of about 1 mm and a depth of about 0.2 mm.

7. A spray valve according to claim 2, wherein the turbulence chamber has an approximately cylindrical diameter of about 0.70 to about 1.30 mm and a height equal to the height of the webs, and the jet orifice has a length/diameter ratio of about 0.3 to about 1.0, the diameter being about 0.3 to about 0.6 mm and the cylindrical recess having a diameter of about 1 mm and a depth of about 0.2 mm.

8. A spray valve according to claim 3, wherein the turbulence chamber has an approximately cylindrical diameter of about 0.70 to about 1.30 mm and a height equal to the height of the webs, and the jet orifice has a length/diameter ratio of about 0.3 to about 1.0, the diameter being about 0.3 to about 0.6 mm and the cylindrical recess having a diameter of about 1 mm and a depth of about 0.2 mm.

* * * * *

Disclaimer 4,322,037.—*Dieter Heeb; Gunter Bechmann; Uwe Bergemann; Volker Bollert;* and *Claus-Dieter Frenzel,* Hamburg, Fed. Rep. of Germany. AERSOL CAN, HAVING A SUPER-FINE ATOMIZATION VALVE, WITH A FILLING WHICH CONTAINS A PROPELLANT, PROCESS FOR ITS MANUFACTURE, AND ITS USE. Patent dated Mar. 30, 1982. Disclaimer filed Apr. 20, 1983, by the assignee, *Hans Schwarzkopf, GmbH.*

Hereby enters this disclaimer to all claims of said patent.

[*Official Gazette June 21, 1983.*]